United States Patent [19]

Voorhis et al.

[11] Patent Number: 4,751,825

[45] Date of Patent: Jun. 21, 1988

[54] DEFROST CONTROL FOR VARIABLE SPEED HEAT PUMPS

[75] Inventors: Roger Voorhis, Liverpool; John M. Palmer, Syracuse; Daryl G. Erbs, Canastota, all of N.Y.

[73] Assignee: Carrier Corporation, Syracuse, N.Y.

[21] Appl. No.: 937,960

[22] Filed: Dec. 4, 1986

[51] Int. Cl.[4] ..... F25D 21/06

[52] U.S. Cl. ..... 62/234; 62/156; 62/155

[58] Field of Search ..... 62/155, 156, 157, 158, 62/234

[56] References Cited

U.S. PATENT DOCUMENTS 4,251,988 2/1981 Allard et al. ..... 62/155 X
4,373,349 2/1983 Mueller ..... 62/155 X
4,417,452 11/1983 Ruminsky et al. ..... 62/156 X
4,573,326 3/1986 Sulfstede et al. ..... 62/156
4,590,771 5/1986 Shaffer et al. ..... 62/156

FOREIGN PATENT DOCUMENTS 0024344 2/1979 Japan ..... 62/156

*Primary Examiner*—Harry B. Tanner
*Attorney, Agent, or Firm*—Dana F. Bigelow

[57] ABSTRACT

An adaptive defrost system for a heat pump wherein the time-between-defrosts is continuously updated by multiplying the last time-between-defrosts by a ratio of the desired and actual differences between the pre-defrost and after-defrost saturated coil temperatures. A single thermistor is used for both pre and after-defrost measurements such that no calibration is required.

19 Claims, 4 Drawing Sheets

DEFROST CONTROL FOR VARIABLE SPEED HEAT PUMPS

BACKGROUND OF THE INVENTION

This invention relates generally to heat pumps and, more particularly, to a method and apparatus for determining when a defrost procedure should be initiated.

An inherent characteristic of an air source heat pump operating in the heating mode is the tendancy to have frost formed on the evaporator coil, with the frost buildup causing a decreasing system efficiency. Accordingly, it is common practice to periodically initiate a defrost cycle by reversing the system (i.e. operating in the cooling mode) for a period of time. Ideally, one would like a defrost system to turn on only when the frost buildup has reached a predetermined level or when the system efficiency has decreased a certain percentage, and then to remain in the defrost mode only for so long as necessary to affect complete defrost. Various control methods and apparatus have therefore have been devised for that purpose.

Known methods of determing the degree of frost buildup on the coil include: using photo-optical techniques; sensing the speed of the fan blade; and measuring the difference in the refrigerant pressure between the inside and the outside coil all of which have certain disadvantages. Another approach that is employed in a so called "demand defrost" system is that of sensing the temperature differences between the coil and the ambient air and when that difference reaches a predetermined level, initiating the defrost cycle. It will be recognized that when this approach, the use of two sensors is required. This, in turn, complicates the solution because of the need to calibrate the two sensors in order to obtain accurate temperature measurements. That is, the thermistors presently available have inherent differences such that when a pair are used, it is necessary to conduct a calibration process for each individual system, which can be time consuming and expensive. Although there are other types of sensors available which are reasonably accurate without calibration, their use in an adaptive defrost system is not economically justifiable.

It is therefore an object of the present invention to provide an improved adaptive defrost system.

Another object of the present invention is the provision in a heat pump adaptive defrost system for maximizing the efficiency over a complete cycle of operation.

Yet another object of the present invention is the provision in an adaptive defrost system for measuring frost buildup on a coil without the use of expensive temperature sensors or calibration techniques.

Still another object of the present invention is the provision for an adaptive defrost system which is economical to manufacture and effective in use.

These objects and other features and advantages become more readily apparent upon reference to the following description when taken in conjunction with the appended drawings.

SUMMARY OF THE INVENTION

The applicants have recognized that the forming of frost on a system brings about a reduction in the saturated evaporator temperature, which causes a lowering of the suction pressure and a loss in efficiency. Further, the change in saturation temperature in going from a clean coil to a frosted coil can be used as a direct measurement of the efficiency degradation due to the buildup of frost. The present invention therefore seeks to optimize the efficiency of a heat pump system during periods of frost accumulation by varying the time period between defrosts in response to the evaporator temperature depression, i.e., the difference in surface temperature at a specified point on the evaporator coil before and after defrost. Accordingly, by one aspect of the invention, the time between defrost is calculated by applying the difference between the pre-defrost and after defrost saturated coil temperatures. Thus, a single sensor is used to measure the degree of frost buildup, with the difference between the pre-defrost and after-defrost saturated coil temperatures being proportional to the level of frost buildup. The time to the next defrost is then calculated as a function of that temperature difference, with the time being inversely proportional to the temperature difference.

The applicants have also found that it is desirable to select a time-between-defrost which results in an optimum evaporator temperature depression at the time of defrost initiation. Since this optimum evaporator temperature depression is dependent on the physical characteristics of the heat pump, it is necessary to consider representative empirical data. Further, the optimum depression can be a function of other variables which affect the heat pump performance. The ambient temperature is the principal such variable to be considered. Accordingly, by another aspect of the invention, optimum differentials between the pre-defrost and after defrost saturated coil temperatures are calculated as a function of ambient temperature. The difference corresponding to the given ambient temperature at any time is then applied to the existing time-between-defrost to calculate a new time-between-defrost. The new time-between-defrost is thus calculated by multiplying the old time-between-defrost by the ratio of the desired and actual differences between the pre-defrost and after defrost saturated coil temperatures.

In the drawings hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
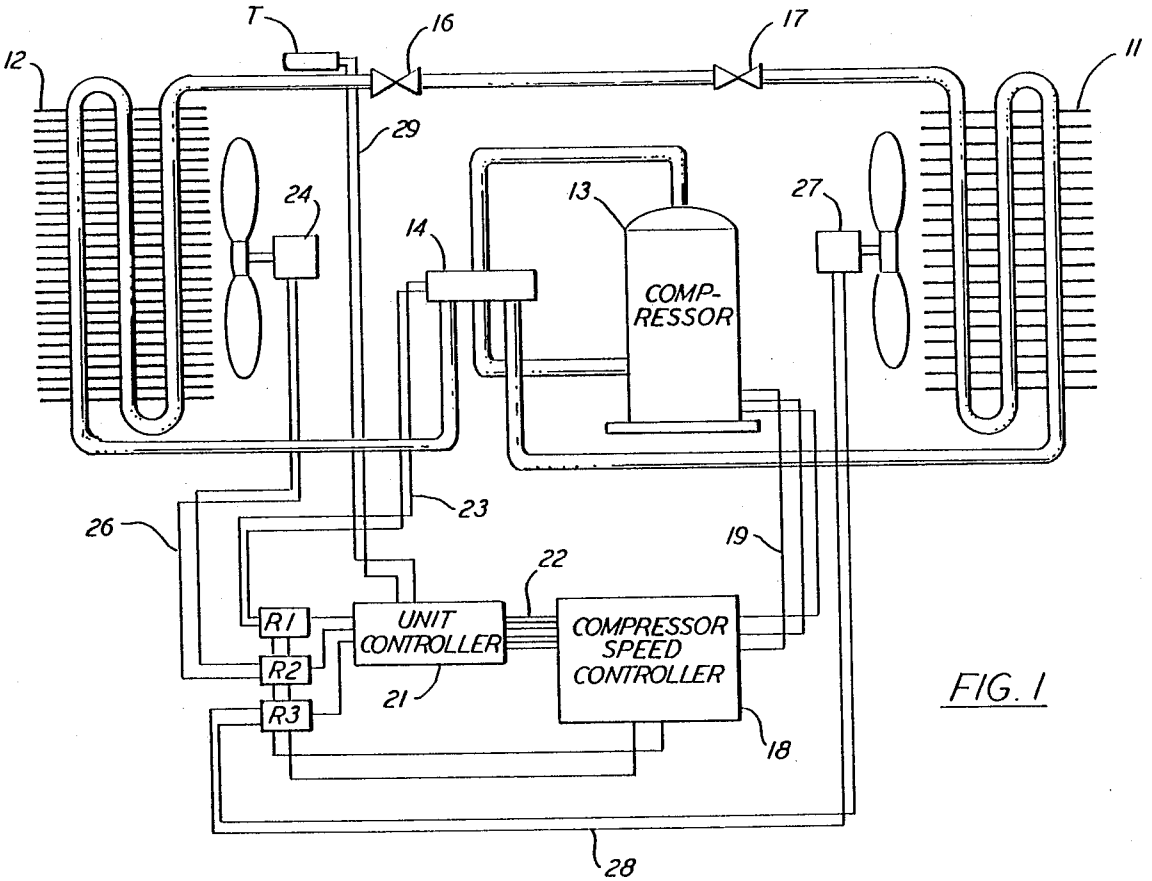
FIG. 1 is a schematic illustration of a heat pump system having the present invention incorporated therein.

Referring now to FIG. 1, there is shown a heat pump system comprising an indoor coil 11, and outdoor coil 12, a compressor 13 and a reversing valve 14. Installed in the line 15 between the indoor and outdoor coils 11 and 12, are expansion valves 16 and 17 with each having provision for bypassing refrigerant when it is not acting as an expansion device. All of these components operate in a rather conventional manner to provide a cooling function while operating in the air conditioning mode and a heating function while operating in a heat pump mode.

Although the present invention is equally applicable to either constant speed or variable speed systems, it will presently be described with reference to a variable speed system. Such a system contemplates the use of variable speed motors such as, for example, electronically commutated motors (ECM's) or inverter driven AC induction motors, to drive the compressor 13, which is normally located in the outdoor coil 12, and the fan for the indoor coil 11. A compressor speed controller 18 is therefore provided to communicate with and to coordinate the operation of the compressor and its associated equipment.

The controller 18 is electrically connected to the compressor 13 by leads 19 and to a unit controller 21 by leads 22. The unit controller is, in turn, connected to; the reversing valve 14 by way of relay R1 and leads 23; the outdoor coil fan 24 by way of relay R2 and leads 26; and to the indoor coil fan 27 by way of relay R3 and leads 28. In addition, the lead unit controller is electrically connected to a thermistor T by way of leads 29.

The present invention is intended to optimize the efficiency of the defrost cycle by initiating the defrost cycle in accordance with a calculated time-to-defrost, with this time being adjusted after each defrost cycle as a function of existing operational parameters to thereby maintain an optimum defrost cycle length. In doing so, the operational parameter that is measured is the saturated evaporator coil temperature (SCT), which is measured both before and after the defrost cycle by a thermistor T, to provide an indication of system performance degradation due to frost accumulation. Since a single thermistor is used for both measurements, the resulting temperature difference measurement can be accurately obtained without an expensive sensor and without calibration.

Figure 2:
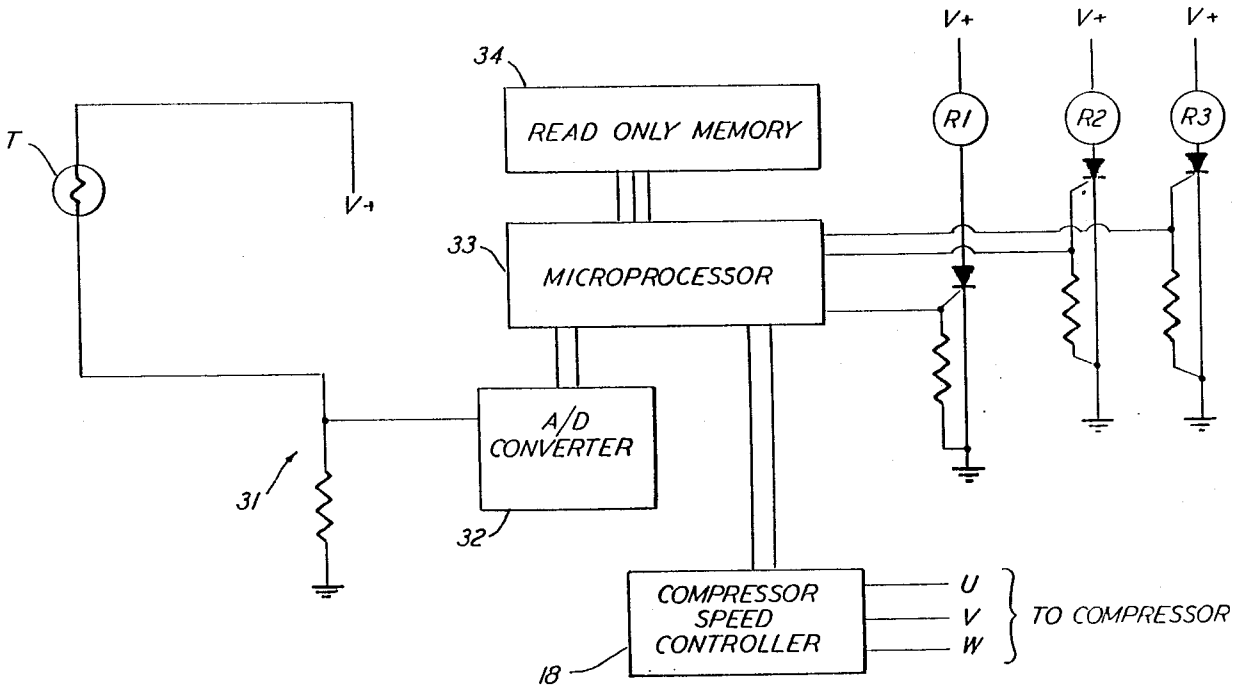
FIG. 2 is a schematic illustration of the unit controller portion of the invention.
Figure 3:
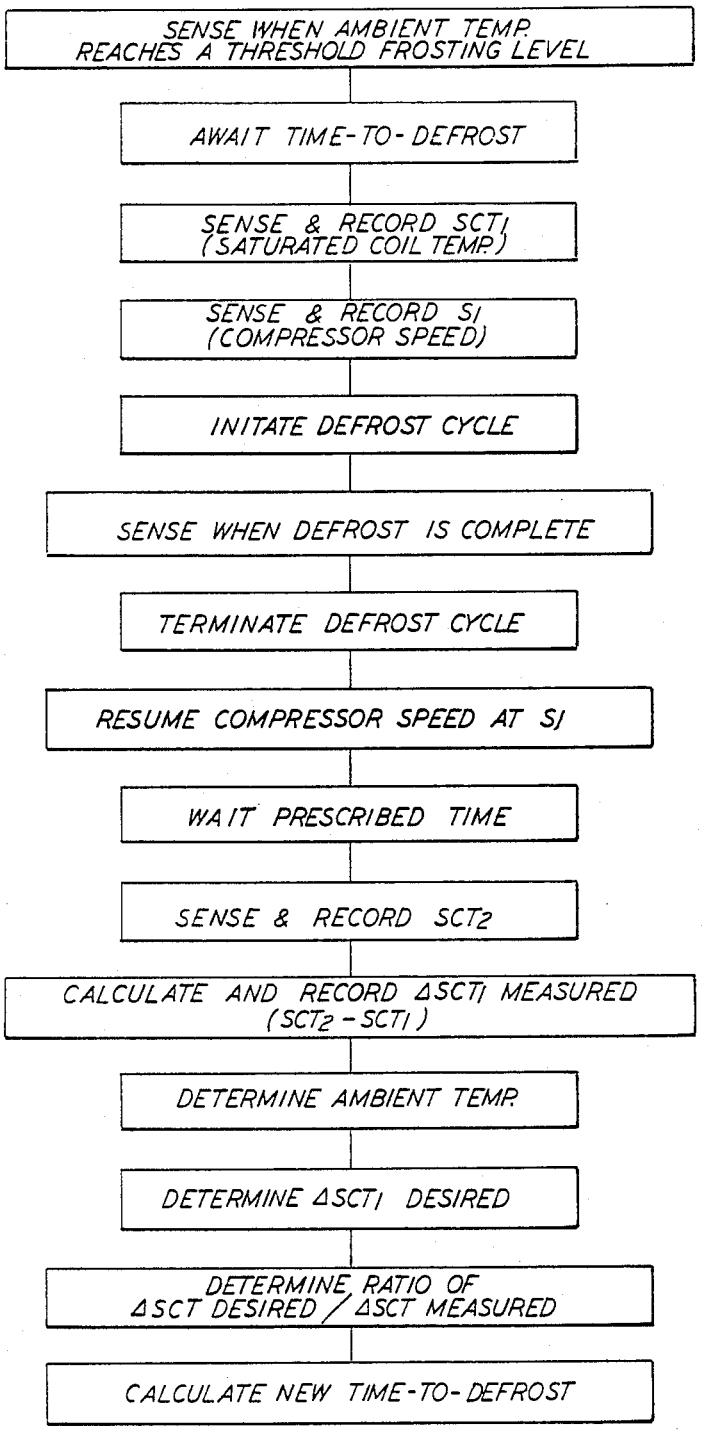
FIG. 3 is a flow diagram showing the sequence of steps to be performed in carrying out the present invention.

FIG. 2 shows the unit controller components that are applicable to the defrost control function. FIG. 3 shows the sequence of the more significant steps taken to determine the time-to-defrost in accordance with the present invention. The temperature at the thermistor T is interpreted through a voltage divider network 31 and an analogue-to-digital converter 32 connected to a microprocessor 33. When the microprocessor 33 begins a defrost pending mode for the first time after ambient conditions (as estimated in a manner to be described hereinafter) indicate the need for active defrosting of the evaporator coil 12, the defrost pending timer in the microprocessor 33 is loaded with an initial waiting period constant stored in the read-only-memory 34. This constant is only used in the initial defrost cycle, inasmuch as the subsequent defrost cycles will use the times obtained by the application of Equation 1 below until such time as the ambient temperature rises sufficiently to no longer require defrosting.

When the timer expires, the microprocessor 33 reads the temperature at the outdoor coil thermistor T and stores this value as the pre-defrost evaporator coil temperature. The compressor speed $S_1$ is also stored in the case of a variable-speed unit. The unit then begins an active defrost cycle by turning off the outdoor fan 24 (relay R2 to off state), energizing the reversing valve 14 (relay R1 to on state), and running the compressor 13 at maximum speed.

Defrost termination is based on the temperature of the liquid refrigerant leaving the outdoor coil 12 when the unit is in the defrost mode. When the liquid temperature reaches a predetermined value measured by the thermistor T, it is known that the coil 12 is free of ice. If the liquid temperature has not reached the termination value before a maximum defrost time period is reached, the defrost cycle terminates on the basis of time in which case, the normal adjustment procedure is not used.

The defrost active timer is loaded with the maximum allowable defrost time period, and the microprocessor 33 begins monitoring the temperature at the outdoor coil thermistor T. The defrost cycle ends when the temperature at this thermistor reaches the termination value stored in the read only memory or the defrost active timer expires. If the defrost is terminated by temperature, the defrost active timer is stopped and the value checked to see if it is within allowable limits. If the defrost is terminated by time, the value at the outdoor coil thermistor T is checked at timeout.

After the defrost cycle has ended, the unit is returned to the heating mode. In the case of the variable-speed unit, the compressor is returned to the speed $S_1$ memorized prior to the initiation of defrost cycle. The unit is then kept running at that speed for a delay period following defrost to allow the outdoor coil temperature to stabilize. At the end of this delay period, the outdoor coil thermistor T is read again and stored as the post-defrost evaporator coil temperature. The difference between the post and pre-defrost evaporator temperatures is calculated and stored as the measured evaporator temperature depression (ΔSCT Measured).

Figure 4:
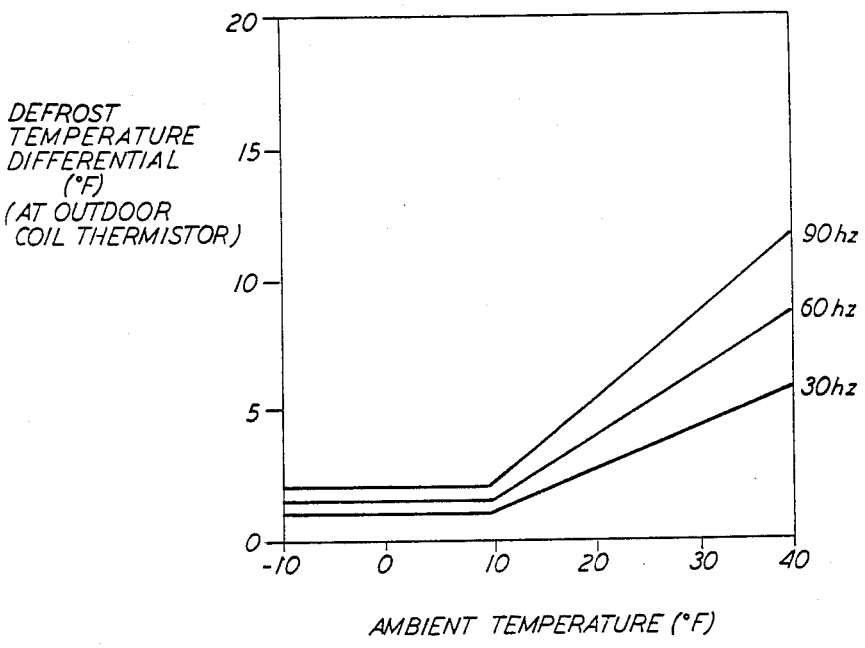
FIG. 4 is a graphic illustration of the optimal defrost temperature differentials plotted as a function of ambient temperatures and motor speeds.

The outdoor dry-bulb temperature is then estimated using the post-defrost coil temperature, and the optimum value for the evaporator coil temperature depression (ΔSCT Desired) is determined as a function of outdoor temperature using a table stored in the read only memory. An exemplary data set for the optimum evaporator temperature depression is shown in FIG. 4.

The time period to wait for the next defrost is then calculated by use of the following formula:

$$\text{Time To-Next-Defrost} = \text{Time-To-Last-Defrost} \times \frac{(\Delta SCT,\ \text{Desired})}{(\Delta SCT,\ \text{Measured})} \qquad \text{(Eq 1)}$$

In order to control the gain associated with the adjustment and provide the desired stability, the above ratio is constrained to remain within the range of 0.5 to 2.0.

If the defrost terminates by temperature and the defrost active timer is beyond the minimum defrost length stored in the read-only-memory 34, the time-to-the-next-defrost is based on the time-to-the-last-defrost and the evaporator temperature depression ΔSCT. If the defrost terminates by temperature but the defrost active timer did not count below the value corresponding to the minimum allowable defrost length, the time-to-the-next-defrost is the time-to-the-last-defrost plus a constant stored in the read-only-memory. If the defrost terminates by time, and the temperature at the outdoor coil thermistor at termination is closer to 0° C. than to the termination temperature, the time-to-the-next-defrost is the minimum defrost period stored in the read-only-memory 34. If the defrost terminates by time, but the outdoor coil temperature is closer to the termination temperature, the time-to-the-next-defrost is the time-to-the-last-defrost minus a constant stored in the read only memory.

The defrost pending timer is set to the new value of the time-to-the-next-defrost and the value is also stored in a memory location for use in the next defrost interval calculation. The outdoor coil temperature is monitored continuously while the unit is running in the defrost pending mode. As long as the ambient conditions stay in the range where defrosting is required, the unit will keep adjusting the defrost waiting period in the manner described above. If, however, the outdoor coil 12 warms to the level where it will no longer have frost formed thereon, the control will cancel the defrost pending mode. Any future defrosts (when conditions once again warrant defrosting) will then begin with the initial waiting period stored in memory.

The defrost pending timer is only decremented while the compressor is running. If the compressor is cycling on and off but the ambient conditions are such that the temperature at the outdoor coil 12 never rises above the temperature value for canceling the defrost pending mode, the microprocessor 33 will start the defrost pending timer each time the compressor 13 starts and will stop the timer each time the compressor stops. The waiting period between defrosts is based on the time during which the coil is building up frost, which requires the compressor to be running, and not the actual time which has elapsed since the last defrost.

It will be understood that the present invention has been described in terms of a preferred embodiment, but it may take on any number of other terms while remaining within the scope and intent of the invention.

What is claimed is:

1. An improved method of determining the time between defrosts in a heat pump system of the type having outdoor and indoor coils and a compressor, comprising the steps sensing when the ambient temperature reaches a predetermined level where frost will form on the outdoor coil;

after a predetermined time to defrost, sensing the pre-defrost saturated outdoor coil temperature and initiating a defrost cycle;

sensing when the temperature of the liquid refrigerant at the outdoor coil reaches a predetermined level to indicate that defrost is complete;

sensing the after-defrost saturated outdoor coil temperature;

determining the actual temperature difference that occurs during the defrost cycle between the pre-defrost and after-defrost saturated coil temperatures; and determining a new time-to-defrost on the basis of said actual temperature difference.

2. The method as set forth in claim 1 wherein the new time-to-defrost period is inversely proportional to said actual temperature difference.

3. The method as set forth in claim 1 including the step of determining a desired temperature difference on the basis of ambient temperature and using said desired temperature difference in determining said new time-to-defrost.

4. The method as set forth in claim 3 wherein said new time-to-defrost is proportional to said desired temperature difference.

5. The method as set forth in claim 3 wherein said new time-to-defrost is calculated using the following formula:

$$\text{New Time-To-Defrost} = \text{Previous Time-To-Defrost} \times \frac{\text{(desired temperature difference)}}{\text{(actual temperature difference)}}$$

6. In a heat pump system having outdoor and indoor coils, a compressor and a reversing valve, a method of calculating the time-to-defrost comprising the steps of:

sensing and recording a pre-defrost saturated outdoor coil temperature;

initiating a defrost cycle and terminating said cycle when certain pre-determined operational parameters are met;

sensing and recording the post-defrost saturated outdoor coil temperature;

determining an actual temperature difference that occurs during the defrost cycle between the pre and post saturated outdoor coil temperatures; and using said actual temperature difference in computing the time-to-defrost.

7. The method as set forth in claim 6 wherein said time-to-defrost is inversely proportional to said actual temperature difference.

8. The method as set forth in claim 6 and including the step of determining a desired temperature difference on the basis of ambient temperature and using said desired temperature difference in computing the time-to-defrost.

9. The method as set forth in claim 8 wherein said time-to-defrost is proportional to said desired temperature difference.

10. The method as set forth in claim 8 wherein said time-to-defrost cycle is computed as a function of the previous time-to-defrost.

11. The method as set forth in claim 10 wherein said time-to-defrost is computed by multiplying the last time-to-defrost by the ratio of said desired temperature difference to said actual temperature difference.

12. The method as set forth in claim 6 wherein said step of terminating said defrost cycle is preceded by the step of sensing when the temperature of the liquid refrigerant in the outdoor coil reaches a predetermined level.

13. An improved adaptive defrost system of the type having an indoor coil, and outdoor coil, a compressor and a reversing valve comprising:

a sensor for sensing the saturated outdoor coil temperature just prior to initiating a defrost cycle;

a sensor for sensing the saturated outdoor coil temperature just after the defrost cycle is terminated; and means for obtaining the actual difference that occurs during the defrost cycle between the two sensed saturated coil temperatures and for calculating a time-to-defrost as a function thereof.

14. An adaptive defrost system as set forth in claim 13 wherein said sensor for sensing the saturated outdoor coil temperature prior to defrost is the same sensor as that for sensing the saturated outdoor coil temperature after defrost.

15. An adaptive defrost system as set forth in claim 14 wherein said sensor is located between the outdoor and indoor coils.

16. An adaptive defrost system as set forth in claim 13 and including a sensor for sensing when the outdoor coil is cold enough to have frost formed thereon and means for initiating the defrost cycle following a predetermined time after the sensing of such a condition.

17. An adaptive defrost system as set forth in claim 16 wherein said sensor is the same sensor as that for sensing the saturated outdoor coil temperature prior to defrost.

18. An adaptive defrost system as set forth in claim 13 and including means for determining as a function of the ambient temperature, a desired difference between the two sensed saturated coil temperatures.

19. An adaptive defrost system as set forth in claim 18 wherein said calculating means calculates the time-to-defrost as a function of said desired difference.

* * * * *